US005392890A

United States Patent [19]

Fabrizio

[11] Patent Number: 5,392,890

[45] Date of Patent: Feb. 28, 1995

[54] OBLITERATOR AND RELATIVE CARD

[75] Inventor: Rigo Fabrizio, Casalecchio Di Reno, Italy

[73] Assignee: O.T.R. S.r.l., Predosa, Italy

[21] Appl. No.: 38,108

[22] Filed: Mar. 29, 1993

[51] Int. Cl.[6] ..... G07F 7/08

[52] U.S. Cl. ..... 194/209; 194/211

[58] Field of Search ..... 194/208, 209, 211, 214, 194/349

[56] References Cited

U.S. PATENT DOCUMENTS

| | | | |
|---|---|---|---|
| 2,977,024 | 3/1961 | Harris | 194/211 X |
| 3,204,741 | 9/1965 | Maxwell et al. | 194/208 |
| 3,595,358 | 7/1971 | Chase | 194/208 |
| 3,944,039 | 3/1976 | Houghtaling | 194/208 |
| 4,364,461 | 12/1982 | Tauber | 194/208 |
| 4,576,273 | 3/1986 | Milnes | 194/209 |

*Primary Examiner*—F. J. Bartuska

*Attorney, Agent, or Firm*—McAulay Fisher Nissen Goldberg & Kiel

[57] ABSTRACT

An obliterating machine can be operated by means of a card, made of synthetic plastic material, that features longitudinal grooves and a toothing and that can be inserted in a receiving seat delimited by a pair of plates mounted within the machine and forming a profile complementar to the profile of the card. A couple of feeler pins, associated with respective micro-switches, are movable along directions perpendicular and parallel to the seat, and are designed to detect the presence of the card and of the first tooth of the toothing. A cogwheel is rotatably supported in adjacency of the seat so that it can engage the toothing, and a cutting blade is made to move in a direction transverse to the seat by an electromagnet to cut a strip from the head of the card while a rocker, that links the blade to the electromagnet, operates a further micro-switch to activate an electric circuit for controlling a vending machine.

9 Claims, 6 Drawing Sheets

OBLITERATOR AND RELATIVE CARD

BACKGROUND OF THE INVENTION

The present invention lies in the technical field concerned with the manufacturing of obliterators and cards made of synthetic plastic material.

DESCRIPTION OF THE PRIOR ART

Obliterating machines already exist of various kinds which are incorporated into vending units for products or services such as drinks, petrol, telephone, tickets and the like. (See U.S. Pat. Nos. 3,204,741 and 3,595,358).

The cards used to activate the obliterating machines and the connected vending units, feature longitudinal grooves and/or ribs disposed so as to define, with respect to a transverse plane, a particular profile that forms the "key" or "code" for a corresponding obliterating machine.

The obliterating machine is provided with a slot into which the card is inserted, the slot being accessible from outside through a window.

There are mechanical feeler pins located within the slot, linked to respective micro-switches that must be actuated when the card is inserted.

In fact, the feeler pins are designed to seek out predetermined areas of the card, e.g. to verify thickness in correspondence with the grooves or with the ribs.

The correct actuation of all the micro-switches allows the vendor to be operated and causes an electromagnet to be energized.

The electromagnet is equipped with a cutting blade adapted to cut a strip at the card head.

Each card has a portion which is removed gradually, by successive cuttings; each strip that is cut corresponds to use the vending unit once.

The above mentioned obliterating machines are subjected to a fraudulent use by operating them by means of improper card adapted to match the slot.

To overcome this problem an obliterating machine, described in the Italian Patent 1,168,392 to the same Applicant, has been equipped with two small cogwheels mounted idle within the slot aimed to receive the card.

The two cogwheels are positioned within recesses each of which communicates laterally with a longitudinal groove made in the slot, and are aimed to receive a toothing made on the card.

Inserting a card in the slot causes the cogs of the cogwheels to engage the card toothings and the feeler pins to be pushed, so that the cutting bleade is operated by the electromagnet and cuts a strip of the card head.

The number of teeth of each longitudinal toothing made on the card is also the number of cuts that can be made for a card, and the last cut is made possible only if a feeler pin enters a hole properly positioned in the card.

This technical solution has given a high reliability to the obliterating machines, particularly has prevented these machines from being deceitfully used.

SUMMARY OF THE INVENTION

The object of the present invention is to provide an obliterating machine that has been improved so as to obtain a high reliability, particularly avoiding a deceitful use of it, but with a very simple structure and easy to assemble, so that a further advantage is obtained as far as production and maintenance costs are concerned.

A further object of the invention is to provide a card that can be used in the best way in conjunction with the obliterating machine described heretofore.

These objects have been achieved by means of an obliterating machine for a card featuring a plurality of grooves and/or ribs and a toothing made in at least one surface of said card, so as to define a predetermined cross profile for said card, with a first tooth of said toothing being near to said head of said card, said machine comprising:

- a front element featuring an opening for allowing a card to pass therethrough;
- a body, protruding from said front element and featuring a recess made in correspondence with said opening, and a cavity that communicate with said recess;
- a pair of plates, upper plate and lower plate respectively, housed within said recess of said body, with counterfacing surfaces of said plates delimiting a seat for receiving said card, said receiving seat having a cross profile complementar to said cross profile of said card;
- a first feeler pin and a first micro-switch, said first feeler pin being movable along a path perpendicular to said seat, so as to push onto said micro-switch when a card is inserted into said receiving seat;
- a second feeler pin and a second micro-switch, said second feeler pin being movable along a path parallel to said card receiving seat, so as to push onto said second micro-switch when a card is inserted into said card receiving seat and said first tooth of said toothing pushes onto said second feeler pin;
- at least one cogwheel rotatably mounted aside of said card receiving seat and arranged with a rotary axis perpendicular to said card receiving seat, said cogwheel being designed to engage said toothing of said card;
- a cutting blade slidably guided within said cavity of said body and along a path perpendicular to said card receiving seat;
- a rocker pivoted to said body and linking said cutting blade to an electromagnet, so as to cut subsequent strips from the head of said card;
- a further micro-switch arranged so as to be operated by said rocker when a strip is cut from said card, in order to activate an electric circuit for controlling the operation of a product or service vending apparatus.

A card is provided for the obliterating machine and includes a toothing made of a series of teeth arranged on a surface in a longitudinal row, with a series of slits respectively positioned between said teeth and arranged in at least one longitudinal row, said slits extending transversely with reference to said card.

Characteristics particular to the invention described herein are set forth below, with reference to the enclosed drawings, in which:

DESCRIPTION OF THE PREFERRED EMBODIMENT

Figure 1:
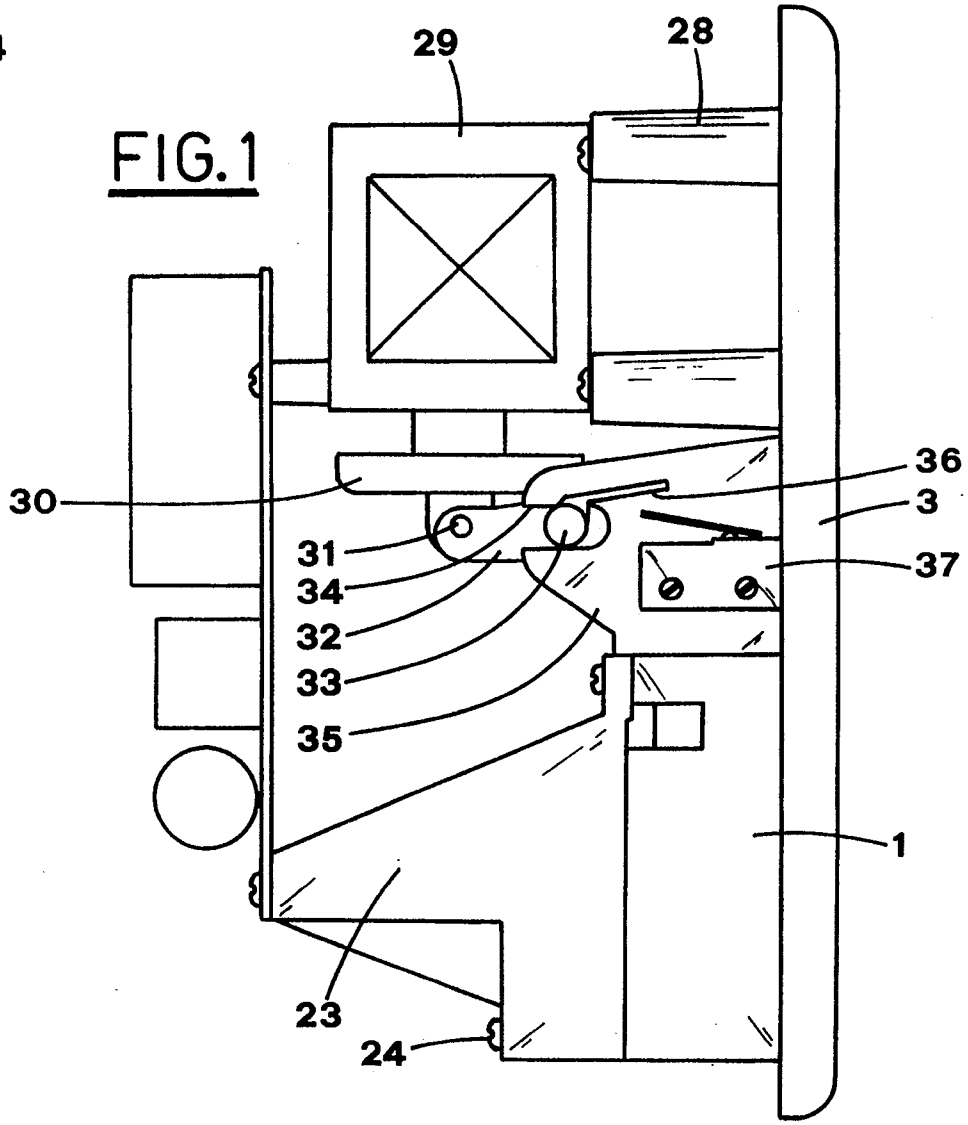
FIG. 1 shows a side view of the machine that is the subject of the present invention.
Figure 2:
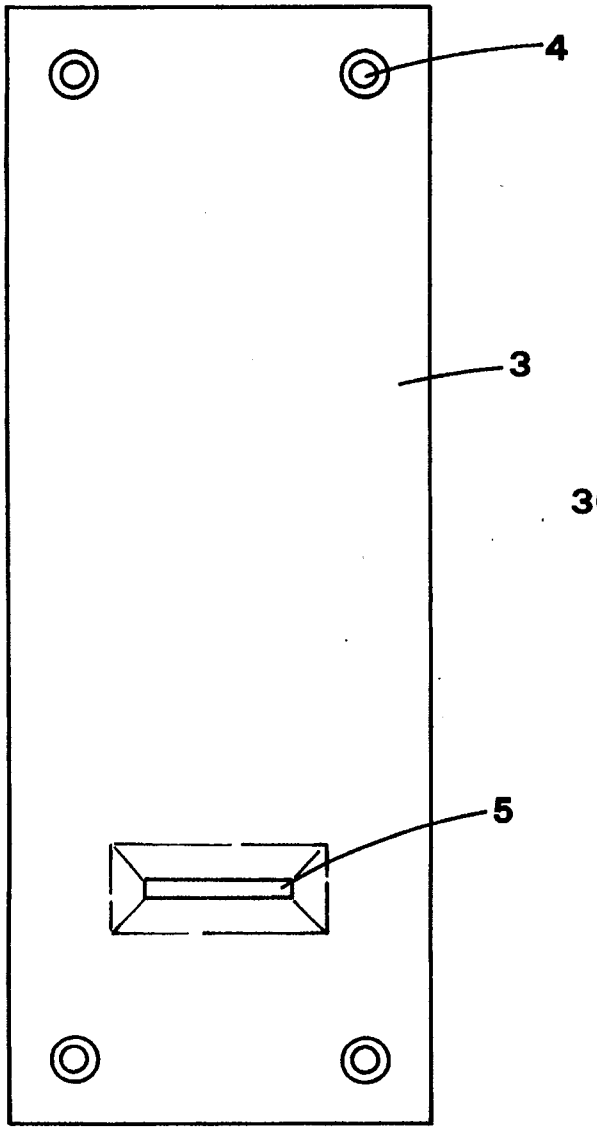
FIG. 2 shows a front view of this obliterating machine.
Figure 3:
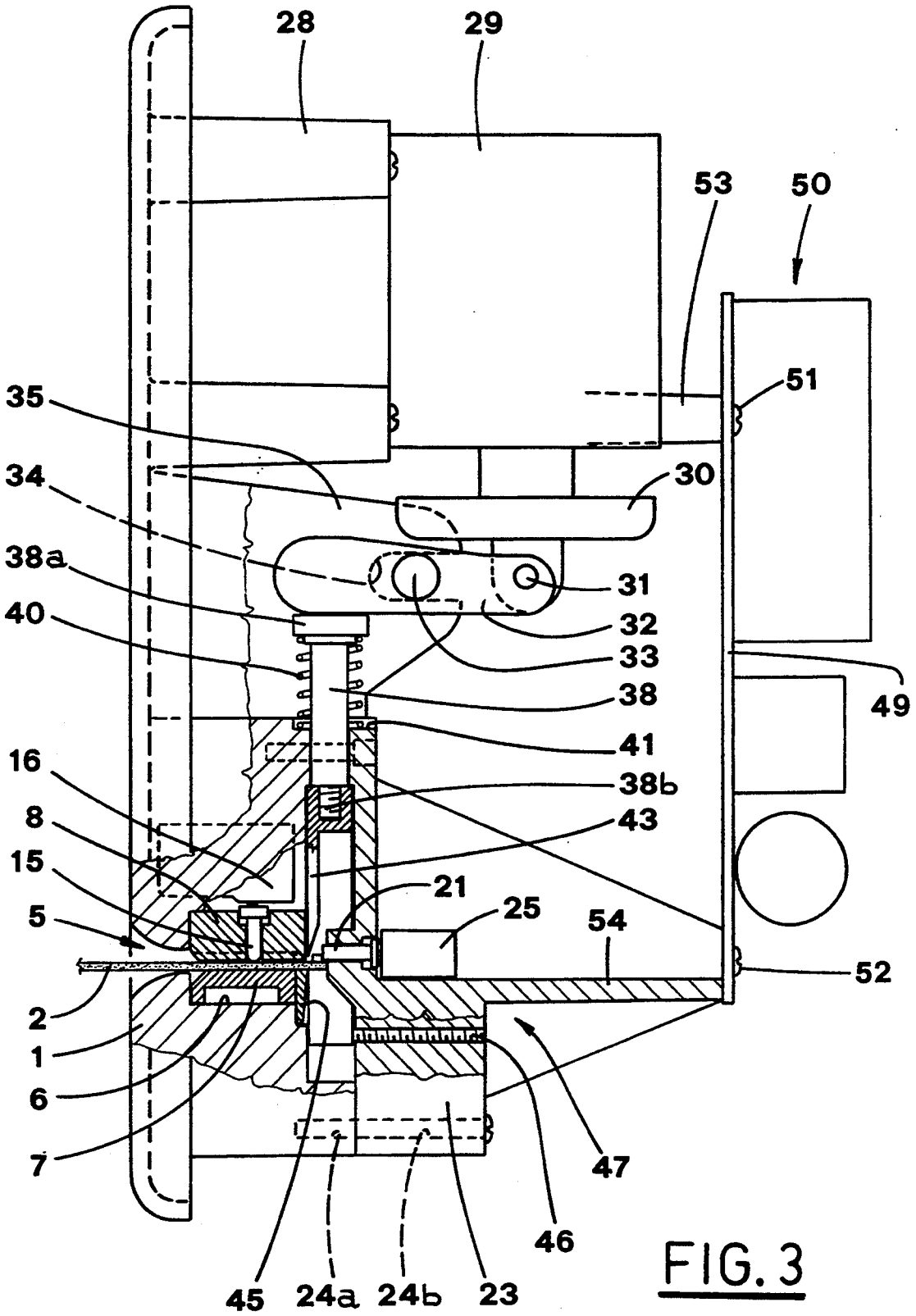
FIG. 3 shows a longitudinal section view of the obliterating machine.
Figure 4:
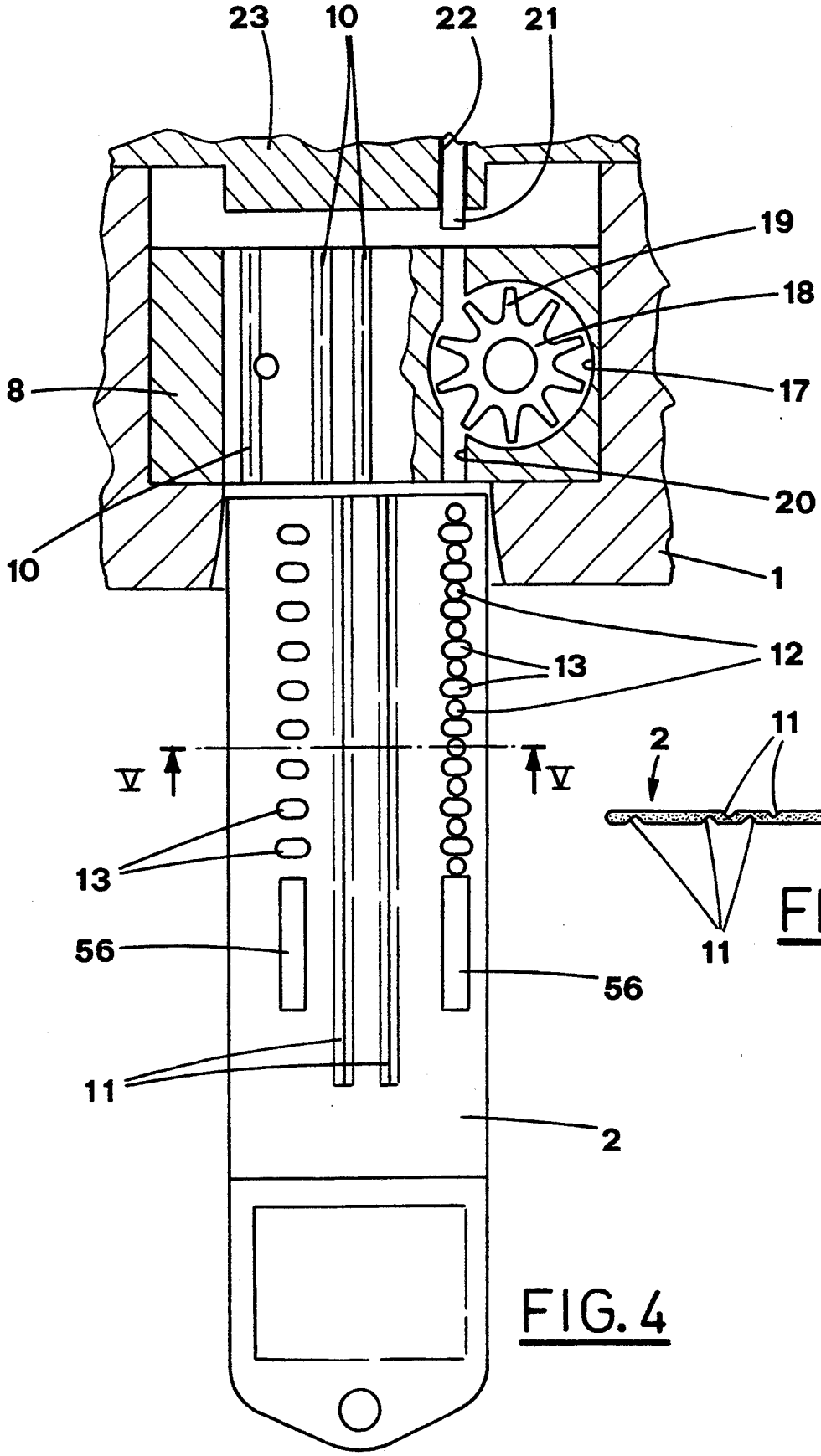
FIG. 4 shows a horizontal section view of parts forming the slot where the card is to be inserted.

With reference to the drawings described above, reference numeral 1 indicates the body of the obliterating machine while reference numeral 2 indicates a card made of synthetic plastic material and designed to be inserted in the slot of the machine to operate an associated vending apparatus (not shown).

The body 1 protrudes from one slide of a front panel 3 that has rectangular shape and features holes 4 for passing fixing screws therethrough.

The front plate 3 has dimensions like the front wall of a conventional coin acceptor, so as to comply with the law requirements.

An opening 5 is made in the frontal plate 3 in order to allow the insertion of a card 2.

The opening, that is flared, leads to a recess 6 made in the body 1.

In the recess 6 there are located a lower plate 7 and an upper plate 8, with a receiving seat 9 being delimited by their counterfacing surfaces.

The seat 9 is designed to receive the card 2 therein.

The plates 7 and 8 feature a plurality of longitudinal ribs 10 made on both couterfacing surfaces and designed to match corresponding longitudinal grooves made on the card 2.

In this way a "code" can be obtained for allowing activation of the vending apparatus.

The card also features a toothing formed by a series of teeth 12 arranged in a longitudinal row and protruding from a facing of the card.

Between each pair of teeth 12 there is a slit 13 having its larger dimension transverse to the card.

The slits 13, respectively positioned between the teeth 12, form a longitudinal row and there is another row of slits parallel to the first one and situated near to the longitudinal card edge opposite to the toothing.

A through hole 14 is made in the upper plate 8 so as to be perpendicular with respect to the receiving seat 9.

A feeler pin 15, designed to act as a sensing means for the card presence, is positioned inside the hole 14, and works in conjunction with a micro-switch 16 fastened to a winglet 8*a* protruding from the plate 8.

The upper plate 8 has also a circular hollow 17 made over the card receiving seat 9 and aimed to house a cogwheel 18.

A longitudinal furrow 20 also made in the upper plate 8 crosses almost tangentially the circular hollow 17, and is adapted to receive the card toothing whose teeth 12 are designed to slide therein.

At the end of the furrow 20 there is a second mechanical feeler pin 21 adapted to detect the first tooth 12 on the card, available at the front end of the toothing.

The feeler pin 21 is inserted, in such a way that it can slide in a through hole 22 coaxial to the furrow 20 and made in a back covering element 23 of the body 1.

The back covering element 23 is fixed to the body 1 by means of screws 24 that grip into holes 24*a*, 24*b* made in the body 1 and in the back covering element 23.

Figure 9:
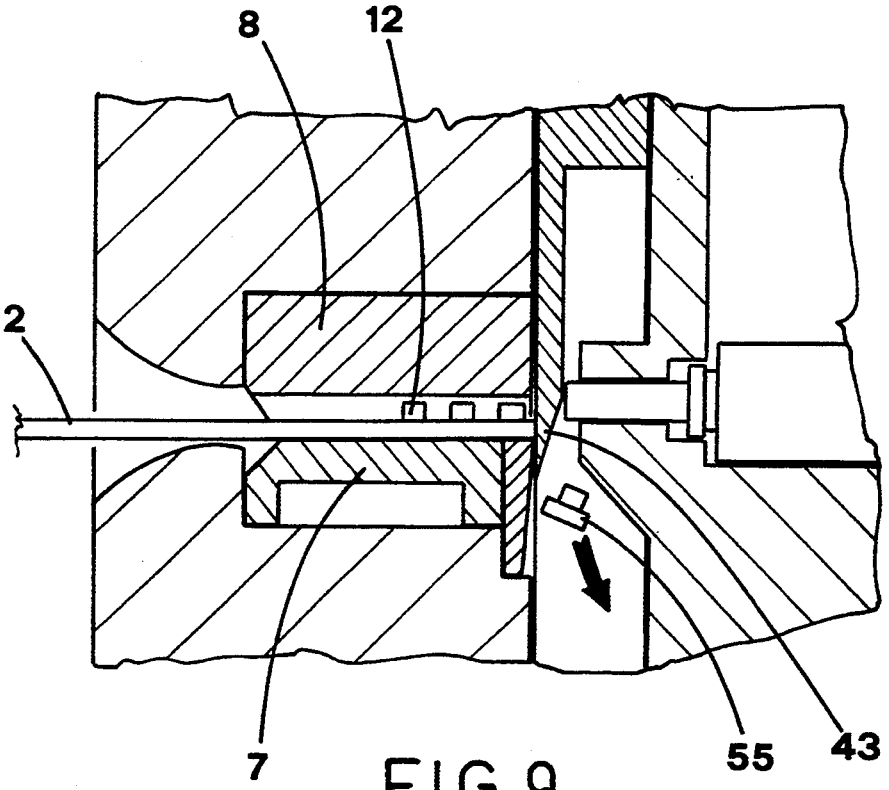
FIG. 9 shows a longitudinal section view of the slot with all details, while a strip is being cut from the card.
Figure 10:
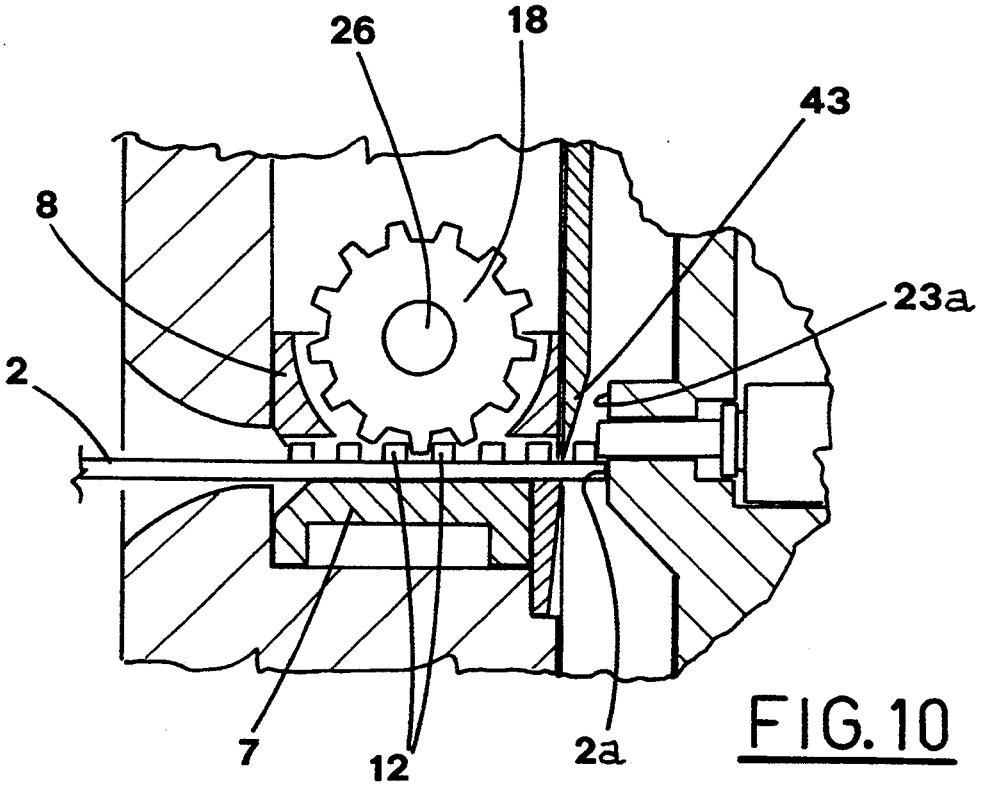
FIG. 10 shows a longitudinal section view of slot made in accordance with another design.

The card head 2*a* that is inside the receiving seat 9, is in abutment onto a stop member 23*a* made on the back covering element surface that faces the seat 9 (see FIGS. 9 and 10).

This stop member features the hole 22 where the feeler pin 21 is located in.

This technical feature allows for an optimum centering of the card 2 while the slits 13 result properly positioned with reference to cutting means, better described hereinafter.

The cogwheel 18 also features a shank 26 that is rotatably supported by the upper plate 8 and held by means of a coventional snap ring 27.

In accordance with a preferred embodiment of the invention, that is better described hereinafter, the card 2 has the rows of teeth 12 made adjacent to the edge so that the shank 26 of the cogwheel 18 is supported by resting onto the lower plate 7.

The feeler pin 15, and the related micro-switch 16, are firstly mounted on the upper plate 8 and then the upper plate 8 is inserted in the recess 6.

A block 28 protrudes from the back side of the front panel 3 and holds an electromagnet 29 fixed thereto.

The electromagnet 29 is equipped with an armature 30 that can move vertically along a path parallel to the front panel 3.

A rocker 32 is linked to the armature 30 by means of a conventional split pin 31 and can oscilate on a vertical plane perpendicular to the front panel 3.

The rocker 32 has a transversal pin 33 that is freely and rotatably inserted in a recess 34 made in a prominence 35 protruding from the back side of the front panel 3, right over the body 1.

An arm 36 is made integral to one end of the pin 33 and is adapted to actuate a further micro-switch 37 fastened to the body 1 beside the prominence 35.

The free branch of the rocker 32 rests onto the enlarged head 38*a* of a stem 38 that slidably runs in a channel 39 made in the body 1.

The channel 39 is oriented perpendicular with reference to the card receiving seat 9.

A spring 40 is set on the stem 38 so as to push onto the head 38*a* of the stem and to rest against a shoulder 41 made in the body 1.

A threaded rod 38*b* protrudes coaxially from the lower end of the stem 38, and a cradle 42, bearing a cutting blade 43, engages the threaded rod 38*b*.

The cradle 42 is guided inside a cavity 44 that is made in the body 1 and that extends perpendicular by with reference to the card receiving seat 9.

The cavity 44 communicates with the recess 6 where the plates 7, 8 are housed and is closed at the back by the back covering element 23.

Fitting up the cutting blade 43 is very easy since it is only necessary to pack the spring 40 against the head 38*a* and then to insert the stem 38 in the groove 39.

Also the electromagnet 29-rocker 32 assembly is very easy to set up.

The rocker can be previously connected to the electromagnet armature by means of the split pin 31 and then the pin 33 can be inserted in the groove 34.

The fitting up can be completed by fixing the electromagnet 29 to the block 28.

A stationary counter-blade 45 is adapted to work in conjunction with the cutting blade 43 in order to cut a strip from the card 2.

The counter-blade 45 is blocked inside the recess 6 of the body 1, clear of the lower plate 7 edge.

The gap between the cutting blade 43 and the counter-blade 45 can be adjusted by means of a pair of dowels 46 which are screwed into respective threaded through holes made in the back covering element 23.

The adjustment dowels 46 push onto a surface of the side pieces of the cradle 42, in accordance with a transverse direction.

The strips severed from the card 2 are made to pass through a discharging outlet 47 that is made in a wall of the cavity 44.

A chute 48, arranged inclined with reference to the movement path of the blade 43, meves the strips toward the outlet.

The obliterating machine is also equipped with an electric circuit 50 for controlling the product or services vending apparatus associate with the obliteratingg machine.

The electric circuit 50 is assembled on a circuit board 49 arranged parallel to the front panel 3 and fixed, by means of screws 51, 52, to a spacer piece 53, protruding from the front panel 3 and to a tail piece 54 protruding from the back covering element 23.

The working of the obliterating machine will be described in the following.

When the card 2 is inserted into the receiving seat 9, passing through the opening 5 made in the front panel 3, the feeler pin 15 is first actuated, and then the teeth 12 engage the cogwheel 18 while sliding along the furrow 20.

Of course, it is possible to effect this action only if the cross profile of the card 2 matches the one of the receiving seat 9.

As already stated this profile may have various shape in accordance with the positioning of the longitudinal grooves 11 and of the longitudinal ribs 10 with reference to the transverse dimension of the card (and of the seat).

Upon touching the upper surface of the card 2, the feeler pin 15 operates the micro-switch 16, which in turn supplies an electric signal corresponding to the card 2 being detected.

The cogwheel 18 allows only the toothing 12 to advance, thus performing a protection action.

Unauthorized attempts to activate the obliterating machine are obstacled by this action (e.g. trying to actuate the feeler pin 21 by means of a metallic wire or the like).

When the card 2 is fully inserted into the seat 9, the second feeler pin 21 detects the first tooth 12 of the toothing, near to the head of the card, and operates the related micro-switch 25.

The micro-switch 25 supplies an electric signal corresponding to the tooth 12 being detected on the card 2.

The activation of both the micro-switches 16 and 25 causes the coil of the electromagnet 29 to be energized and the armature 30 to go upwards, so that the rocker 32 is consequently made to rotate.

The rocker 32 pushes onto the head 38*a* of the stem 38 so that the cutting blade 43 is lowered against the elastic reaction of the spring 40.

While going down, the cutting blade 43 encounters the stationary counter-blade 45 and consequently a strip is cut from the head of the card 2.

This strip is large like the distance between the transverse axes of two subsequent slits.

The strip 55, just cut, falls down passing through the discharge outlet 47, as it can be seen in FIG. 9.

The card is severed along the transverse axis of two slits 13, due to the perfect positioning of the card whose head 2*a* goes in abutment on the stop member 23*a*.

In other words, the perfect positioning of the card allows to locate the axis of the first two slits 13 in the path of the cutting blade 43.

When the strip 55 is cut, the arm 36 connected with the rocker 32 operates the further micro-switch 37 which in turn activates the control circuit 50 for the working of the product or service vending apparatus.

Obviously, trying to activate the obliterating machine with a card that is too hard to be cut by the blade 43 causes the rocker 32 to rotate along a too narrow angle, so that the micro-switch 37 is not operated and the circuit 50 does not work.

Furthermore, the obliterating machine made in accordance with the invention is able to safely detect the correct positioning of the card and to activate the vending apparatus only after that the card is severed.

The particular profile of the card receiving seat 9 and the cogwheel 18 make any attempt of unauthorized use very hard.

Also the particular shape of the card 2 helps on with the safe correct use.

In particular, the two rows of slits, whose axes pass in the middle between the subsequent couples of teeth 12, prevent anybody from making in these areas prominences which could work as the same teeth 12.

To the same safety extent, two longitudinal slots 56 are made in the region of the card located at the end of the two rows of slits, so as to prevent the card from being used after that the last tooth of the toothing 12 has been cut away.

Figure 5:
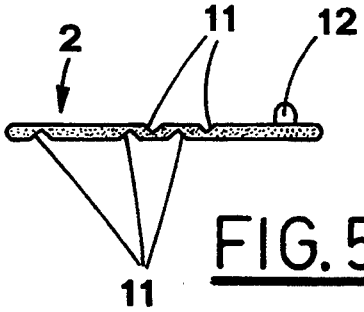
FIG. 5 shows a cross section of the card taken along the line V—V of FIG. 4.
Figure 6:
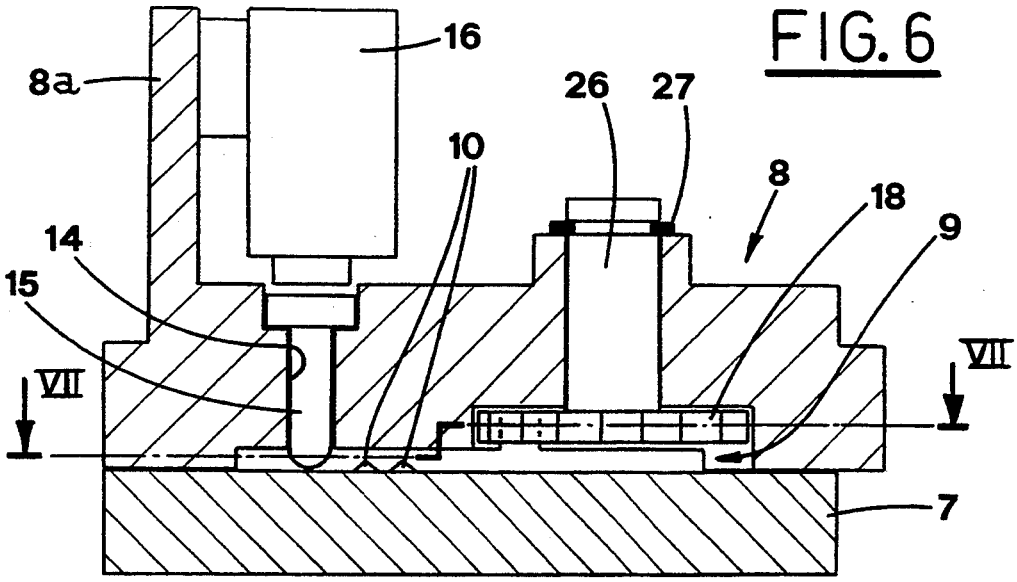
FIG. 6 shows a cross section of the slot.
Figure 7:
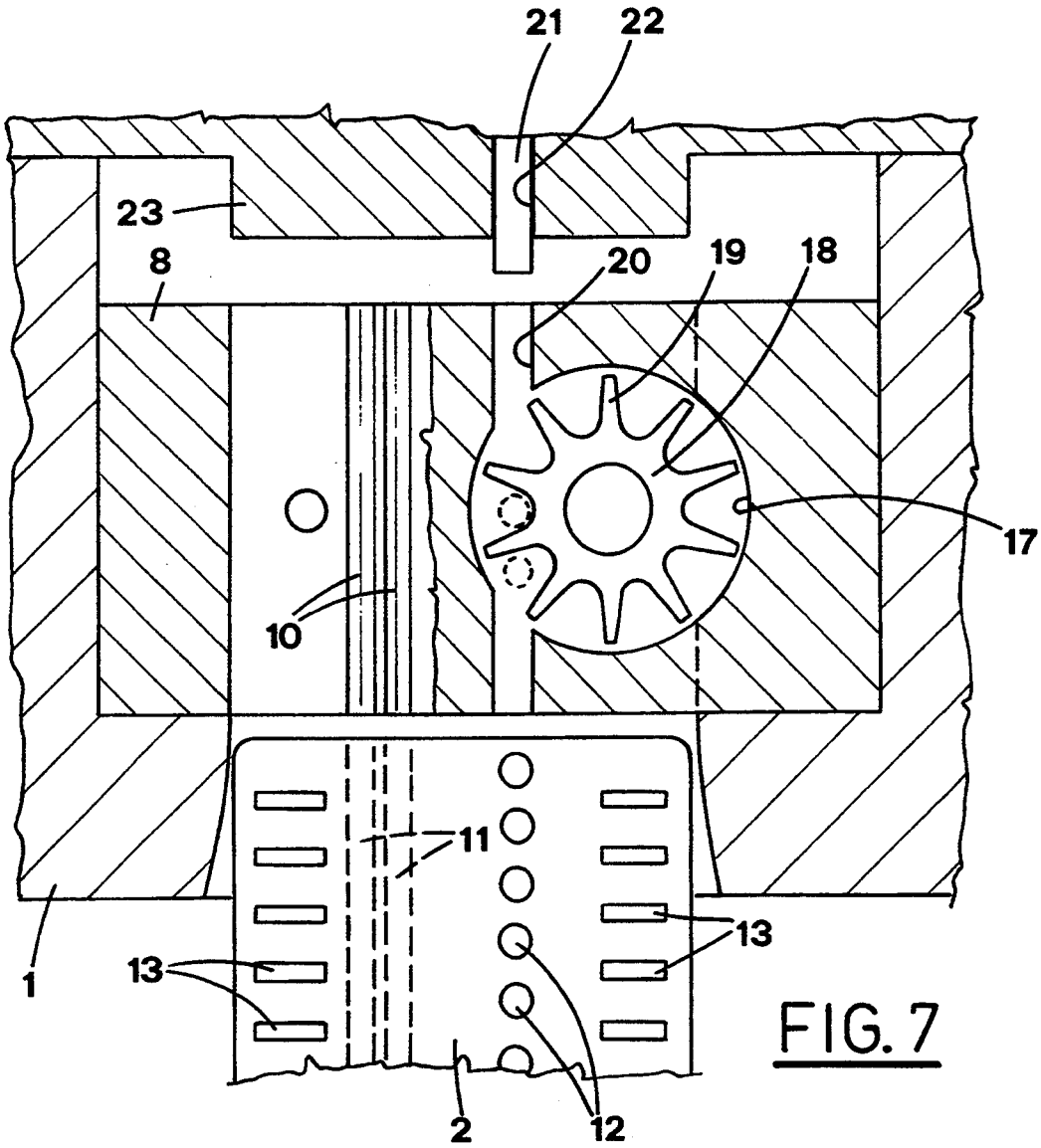
FIG. 7 shows a section view of the slot taken along the line VII—VII of FIG. 6.
Figure 8:
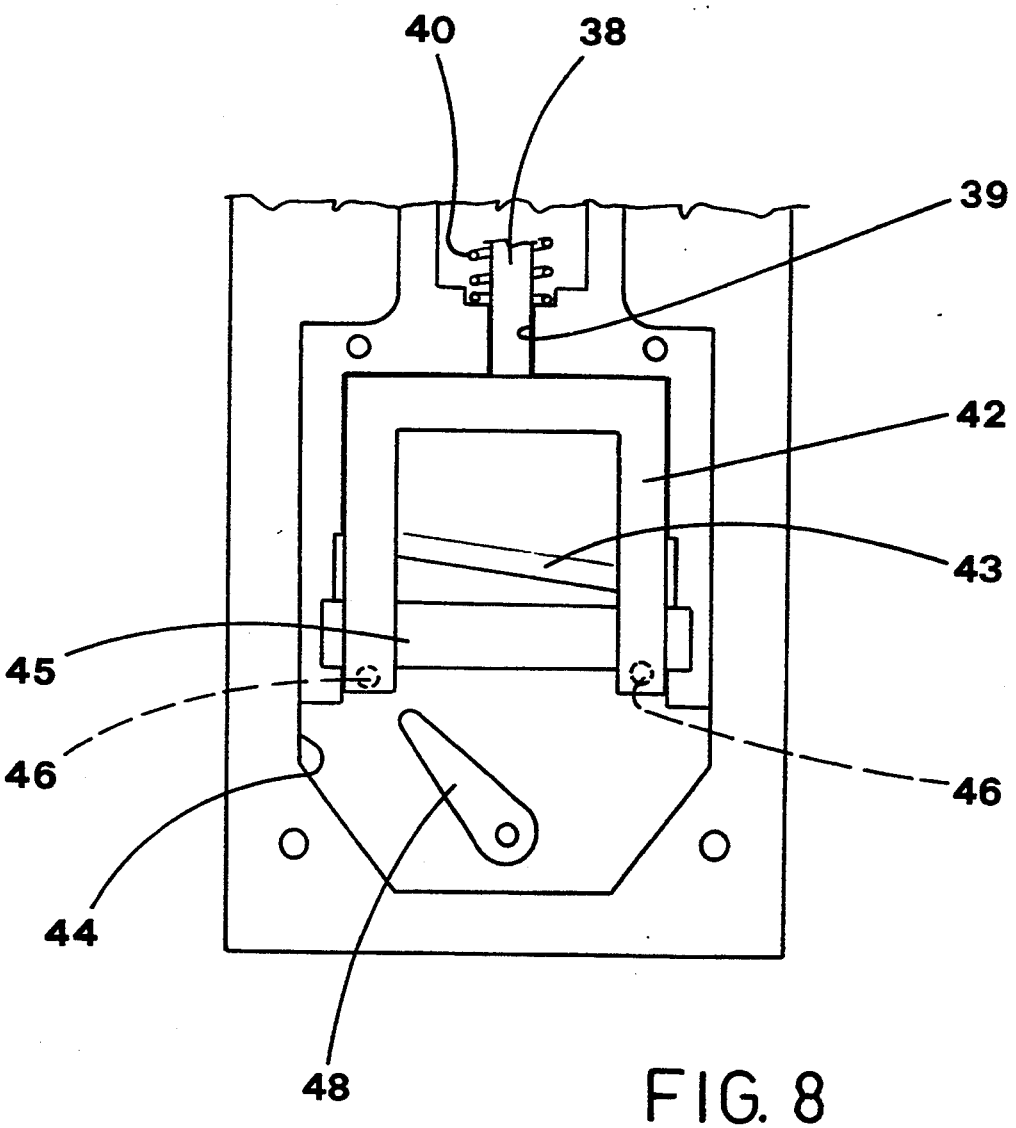
FIG. 8 shows a section view of the cutting means of this obliterating machine.

Advantegeously, the longitudinal grooves 11 made on the two surfaces of the card 2 have a "V" cross section as shown in FIG. 5.

This allows for larger number of grooves to be set in the card, since the upper surface grooves can be alternated with the lower surface ones, without that the formers interfere with the latters.

Therefore, it is more difficult to counterfait the card.

The subject obliterating machine is made up of very few components which are very easy to fit up.

Particularly all the components are connected to each other mostly by a press fit, or even only by a juxtaposition, and everything is finally blocked by means of conventional screws.

This allows for advantages to be clearly obtained as for production cost, and for maintenance as well.

According to a variation of the obliterating machine described hereinabove, the cogwheel 18 can be set with horizontal axis, transverse with reference to the card receiving seat 9, as shown in FIG. 10.

In this case the cogwheel 18 is rotatably supposed within a semi-circular hollow 57 made in the upper plate 8.

The semi-circular hollow 57 extends along a vertical plane on which the toothing 12 passes.

It is to be understood that all what above, has been said only as an example.

All possible variations of the invention are comprised in the scope of the claims and of the above specification.

What is claimed:

1. An obliterating machine for a card designed to be inserted with a head within said obliterating machine, said card being made of synthetic plastic material and featuring a plurality of grooves and/or ribs and a toothing made in at least one surface of said card, so as to define a predetermined cross profile for said card, with a first tooth of said toothing being near to said head of said card, said machine comprising:

a front panel featuring an opening for allowing a card to pass therethrough;

a body, protruding from said front panel and featuring a recess made in correspondence with said opening, and a cavity that communicate with said recess;

a pair of plates, upper plate and lower plate respectively, housed within said recess of said body, with counterfacing surfaces of said plates delimiting a seat for receiving said card, said receiving seat having a cross profile complementar to said cross profile of said card;

a first feeler pin and a first micro-switch, said first feeler pin being movable along a path perpendicular to said seat, so as to push onto said micro-switch when a card is inserted into said receiving seat;

a second feeler pin and a second micro-switch, said second feeler pin being movable along a path parallel to said card receiving seat, so as to push onto said second micro-switch when a card is inserted into said card receiving seat and said first tooth of said toothing pushes onto said second feeler pin;

at least one cogwheel rotatably mounted aside of said card receiving seat and arranged with a rotary axis perpendicular to said card receiving seat, said cogwheel being designed to engage said toothing of said card;

a cutting blade slidably guided within said cavity of said body and along a path perpendicular to said card receiving seat;

a rocker pivoted to said body and linking said cutting blade to an electromagnet, so as to cut subsequent strips from the head of said card;

a further micro-switch arranged so as to be operated by said rocker when a strip is cut from said card, in order to activate an electric circuit for controlling the operation of a product or service vending apparatus.

2. A machine as in claim 1, wherein said rocker has a transverse pin that is rotatably supported in a recess made in a prominence protruding from a back side of said frontal panel, said rocker having a free end resting onto an enlarged head of a stem connected to said cutting blade, this stem lying in a channel made in said body and arranged perpendicular to said card receiving seat, with a spring set on said stem and resting onto a shoulder made in said body, while pushing on said head of said stem.

3. A machine as in claim 1, wherein an arm is made integral with an end of a support pin made intergral with and transverse to said rocker, said arm being adapted to operate said further micro-switch.

4. A machine as in claim 1 wherein said cutting blade is supported by a cradle that is slidably guided within said cavity of said body, said cradle being subjected to the action of said rocker via a stem that is located between said cradle and rocker.

5. A machine as in claim 1, wherein there is a stationary counter-blade adapted to work in conjunction with said cutting blade, said counter-blade being mounted within said recess of said body, clear of said lower plate, with a pair of dowels screwed within threaded through holes made in a back covering element fixed to said body, said dowels being designed to push transversely on a cradle supporting said cutting blade in order to adjust the gap between said cutting blade and said stationary counter-blade.

6. A machine as in claim 1, wherein said first feeler pin is positioned within a through hole made in said upper plate and perpendicular to said card receiving seat, with said first micro-switch fixed to a winglet protruding from said upper plate.

7. A machine as in claim 1, wherein said cogwheel is housed in a circular hollow made in said upper plate and in correspondence with said card receiving seat, with a longitudinal furrow made in said upper plate and crossing said circular hollow in adjacency of the outline, said longitudinal furrow being designed to receive slidingly said toothing of said card, and leading to said second feeler pin.

8. A machine as in claim 1, wherein said second feeler pin is slidably inserted within a through hole made in a back covering element fixed to said body by means of screws, with said second micro-switch, connected with said second feeler pin, being fixed to said back covering element.

9. A machine as in claim 1, wherein said cavity of said body is closed at the back by a back covering element fixed to said body.

* * * * *